US009151500B2

(12) United States Patent
Chen et al.

(10) Patent No.: US 9,151,500 B2
(45) Date of Patent: Oct. 6, 2015

(54) SYSTEM FOR SUPPLYING A FUEL AND A WORKING FLUID THROUGH A LINER TO A COMBUSTION CHAMBER

(75) Inventors: Wei Chen, Greer, SC (US); Patrick Benedict Melton, Horse Shoe, NC (US); Russell DeForest, Simpsonville, SC (US); Lucas John Stoia, Taylors, SC (US); Richard Martin DiCintio, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 756 days.

(21) Appl. No.: 13/420,715

(22) Filed: Mar. 15, 2012

(65) Prior Publication Data

US 2013/0239575 A1 Sep. 19, 2013

(51) Int. Cl.

| | |
|---|---|
| ***F23R 3/34*** | (2006.01) |
| ***F23R 3/04*** | (2006.01) |
| ***F23R 3/28*** | (2006.01) |
| *F01D 9/02* | (2006.01) |

(52) U.S. Cl.

CPC . *F23R 3/04* (2013.01); *F23R 3/286* (2013.01); *F01D 9/023* (2013.01); *F23R 3/346* (2013.01)

(58) Field of Classification Search

CPC ..... F01D 9/023; F23C 6/047; F23R 3/002; F23R 3/005; F23R 3/283; F23R 3/286; F23R 3/346

USPC ..... 60/39.37, 733, 737, 740, 746, 747

See application file for complete search history.

(56) References Cited

U.S. PATENT DOCUMENTS

| | | | | |
|---|---|---|---|---|
| 2,792,058 | A | | 5/1957 | Thomas et al. |
| 2,922,279 | A | | 1/1960 | Roberson et al. |
| 3,377,803 | A | * | 4/1968 | Prachar ..... 60/761 |
| 3,934,409 | A | | 1/1976 | Quillevere et al. |
| 4,040,252 | A | | 8/1977 | Mosier et al. |
| 4,045,956 | A | | 9/1977 | Markowski et al. |
| 4,112,676 | A | | 9/1978 | DeCorso |
| 4,192,139 | A | | 3/1980 | Buchheim |
| 4,253,301 | A | | 3/1981 | Vogt |

(Continued)

FOREIGN PATENT DOCUMENTS

| | | |
|---|---|---|
| EP | 2236935 | 6/2010 |
| EP | 2206964 A2 | 7/2012 |

(Continued)

OTHER PUBLICATIONS

Co-pending U.S. Appl. No. 13/466,184, Melton, et al. flied May 8, 2012.

(Continued)

*Primary Examiner* — Phutthiwat Wongwian
*Assistant Examiner* — Lorne Meade
(74) *Attorney, Agent, or Firm* — Dority & Manning, PA

(57) ABSTRACT

A system for supplying a working fluid to a combustor includes a combustion chamber and a flow sleeve that circumferentially surrounds at least a portion of the combustion chamber. A tube provides fluid communication for the working fluid to flow through the flow sleeve and into the combustion chamber, wherein the tube comprises an axial centerline. A first set of injectors are circumferentially arranged around the tube and angled radially with respect to the axial centerline of the tube, wherein the first set of injectors provide fluid communication for the working fluid to flow through a wall of the tube.

10 Claims, 3 Drawing Sheets

(56) References Cited

U.S. PATENT DOCUMENTS

| | | | | |
|---|---|---|---|---|
| 4,288,980 | A | 9/1981 | Ernst | |
| 4,928,481 | A | 5/1990 | Joshi et al. | |
| 5,054,280 | A | 10/1991 | Ishibashi et al. | |
| 5,099,644 | A | 3/1992 | Sabla et al. | |
| 5,127,229 | A | 7/1992 | Ishibashi et al. | |
| 5,285,628 | A | 2/1994 | Korenberg | |
| 5,297,391 | A | 3/1994 | Roche | |
| 5,321,948 | A | 6/1994 | Leonard | |
| 5,450,724 | A * | 9/1995 | Kesseli et al. | 60/737 |
| 5,450,725 | A | 9/1995 | Takahara et al. | |
| 5,623,819 | A | 4/1997 | Bowker et al. | |
| 5,749,219 | A * | 5/1998 | DuBell | 60/804 |
| 5,974,781 | A | 11/1999 | Correa et al. | |
| 6,047,550 | A | 4/2000 | Beebe | |
| 6,178,737 | B1 | 1/2001 | Lenertz et al. | |
| 6,192,688 | B1 | 2/2001 | Beebe | |
| 6,253,538 | B1 | 7/2001 | Sampath et al. | |
| 6,834,505 | B2 * | 12/2004 | Al-Roub et al. | 60/737 |
| 6,868,676 | B1 | 3/2005 | Haynes | |
| 6,925,809 | B2 | 8/2005 | Mowill | |
| 6,935,116 | B2 | 8/2005 | Stuttaford et al. | |
| 7,137,256 | B1 | 11/2006 | Stuttaford et al. | |
| 7,162,875 | B2 | 1/2007 | Fletcher et al. | |
| 7,237,384 | B2 | 7/2007 | Stuttaford et al. | |
| 7,425,127 | B2 | 9/2008 | Zinn | |
| 7,665,309 | B2 | 2/2010 | Parker et al. | |
| 8,205,452 | B2 | 6/2012 | Boardman et al. | |
| 8,407,892 | B2 | 4/2013 | DiCintio et al. | |
| 8,475,160 | B2 | 7/2013 | Campbell et al. | |
| 8,516,820 | B2 * | 8/2013 | Ramier et al. | 60/737 |
| 8,590,311 | B2 | 11/2013 | Parsania et al. | |
| 8,601,820 | B2 | 12/2013 | Byrne et al. | |
| 8,656,721 | B2 | 2/2014 | Matsumoto et al. | |
| 8,683,804 | B2 | 4/2014 | Boardman et al. | |
| 8,752,386 | B2 | 6/2014 | Fox et al. | |
| 8,919,137 | B2 | 12/2014 | DiCintio et al. | |
| 9,010,082 | B2 | 4/2015 | Stoia et al. | |
| 9,010,120 | B2 | 4/2015 | DiCintio et al. | |
| 2005/0095542 | A1 * | 5/2005 | Sanders et al. | 431/195 |
| 2005/0097889 | A1 * | 5/2005 | Pilatis et al. | 60/743 |
| 2007/0022758 | A1 * | 2/2007 | Myers et al. | 60/776 |
| 2007/0137207 | A1 * | 6/2007 | Mancini et al. | 60/737 |
| 2009/0084082 | A1 | 4/2009 | Martin et al. | |
| 2010/0018208 | A1 * | 1/2010 | Ritland | 60/737 |
| 2010/0018209 | A1 * | 1/2010 | Ramier et al. | 60/740 |
| 2010/0170254 | A1 * | 7/2010 | Venkataraman et al. | 60/746 |
| 2010/0174466 | A1 | 7/2010 | Davis, Jr. et al. | |
| 2010/0212324 | A1 | 8/2010 | Bronson et al. | |
| 2011/0056206 | A1 * | 3/2011 | Wiebe | 60/740 |
| 2011/0067402 | A1 * | 3/2011 | Wiebe et al. | 60/740 |
| 2011/0131998 | A1 | 6/2011 | Nadkarni et al. | |
| 2011/0179803 | A1 | 7/2011 | Berry et al. | |
| 2011/0296839 | A1 * | 12/2011 | Van Nieuwenhuizen et al. | 60/737 |
| 2013/0008169 | A1 * | 1/2013 | Belsom et al. | 60/740 |
| 2013/0067921 | A1 | 3/2013 | Hadley et al. | |
| 2013/0174558 | A1 | 7/2013 | Stryapunin | |

FOREIGN PATENT DOCUMENTS

| | | |
|---|---|---|
| EP | 2613082 | 10/2013 |
| JP | 2006138566 | 6/2006 |
| WO | WO 2004/035187 A2 | 4/2004 |

OTHER PUBLICATIONS

Co-pending U.S. Appl. No. 13/349,886, Stoia, et al., filed Jan. 13, 2012.

Co-pending U.S. Appl. No. 13/344,877, Stoia, et al, filed Jan. 6, 2012.

Co-pending U.S. Appl. No. 13/349,906, Stoia, et al., filed Jan. 13, 2012.

Co-pending U.S. Appl. No. 13/455,429, Romig, et al., filed Apr. 25, 2012.

Co-pending U.S. Appl. No. 13/455,480, Stoia, et al., filed Apr. 25, 2012.

Co-pending U.S. Appl. No. 14/122,694, Shershnyov, filed Nov. 27, 2013.

Co-pending U.S. Appl. No. 14/122,697, Shershnyov, filed Nov. 27, 2013.

Co-pending U.S. Appl. No. 13/417.405, Chen et al., filed Mar. 12, 2012.

* cited by examiner

SYSTEM FOR SUPPLYING A FUEL AND A WORKING FLUID THROUGH A LINER TO A COMBUSTION CHAMBER

FIELD OF THE INVENTION

The present invention generally involves a system for supplying a working fluid to a combustor. In particular embodiments, the present invention may supply a lean fuel-air mixture to the combustion chamber through late lean injectors circumferentially arranged around the combustion chamber.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows into a combustion chamber where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by fuel nozzles, possibly causing severe damage to the fuel nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, one or more late lean injectors or tubes may be circumferentially arranged around the combustion chamber downstream from the fuel nozzles. A portion of the compressed working fluid exiting the compressor may flow through the tubes to mix with fuel to produce a lean fuel-air mixture. The lean fuel-air mixture may then be injected into the combustion chamber, resulting in additional combustion that raises the combustion gas temperature and increases the thermodynamic efficiency of the combustor.

The late lean injectors are effective at increasing combustion gas temperatures without producing a corresponding increase in the production of $NO_X$. However, the fuel injected into the combustion chamber through the late lean injectors typically has a limited residence time inside the tubes to adequately mix with the compressed working fluid. In addition, the fuel-air mixture flowing out of the tubes creates conditions inside the tubes that may be susceptible to localized flame holding. As a result, an improved system for supplying working fluid to the combustor that enhances mixing between the fuel and working fluid inside the tubes and/or reduces the conditions for flame holding would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supplying a working fluid to a combustor. The system includes a combustion chamber and a flow sleeve that circumferentially surrounds at least a portion of the combustion chamber. A tube provides fluid communication for the working fluid to flow through the flow sleeve and into the combustion chamber, wherein the tube comprises an axial centerline. A first set of injectors are circumferentially arranged around the tube and angled radially with respect to the axial centerline of the tube, wherein the first set of injectors provide fluid communication for the working fluid to flow through a wall of the tube.

Another embodiment of the present invention is a system for supplying a working fluid to a combustor that includes a combustion chamber, a liner that circumferentially surrounds at least a portion of the combustion chamber, and a flow sleeve that circumferentially surrounds at least a portion of the liner. A tube provides fluid communication for the working fluid to flow through the flow sleeve and the liner and into the combustion chamber, wherein the tube comprises an outer wall, an inner wall separated radially from the outer wall, and an axial centerline. A first set of injectors are circumferentially arranged around the tube and angled radially with respect to the axial centerline of the tube, wherein the first set of injectors provide fluid communication for the working fluid to flow through the outer wall and the inner wall and into the tube.

The present invention may also include a system for supplying a working fluid to a combustor that includes a combustion chamber, a liner that circumferentially surrounds at least a portion of the combustion chamber, and a flow sleeve that circumferentially surrounds at least a portion of the liner. A tube provides fluid communication for the working fluid to flow through the flow sleeve and the liner and into the combustion chamber. A first set of injectors provide fluid communication for the working fluid to flow through a wall of the tube, wherein the first set of injectors are angled radially with respect to the axial centerline of the tube. A second set of injectors are downstream from the first set of injectors, wherein the second set of injectors provide fluid communication for the working fluid to flow through the wall of the tube.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
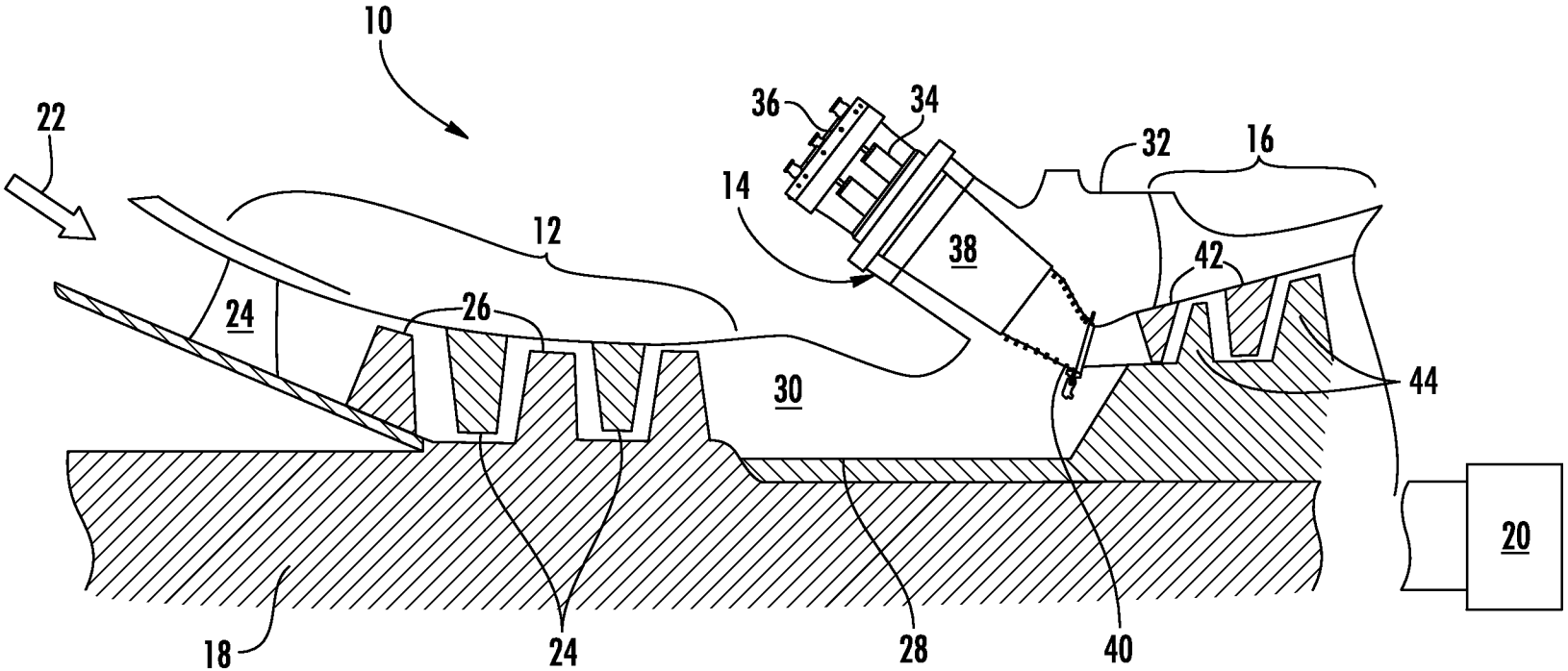
FIG. 1 is a simplified side cross-section view of an exemplary gas turbine.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system for supplying a working fluid to a combustor. The system generally includes one or more late lean injectors circumferentially arranged around a combustion chamber to inject a lean mixture of fuel and working fluid into the combustion chamber. Each late lean injector generally includes a tube that provides fluid communication for the working fluid into the combustor, and one or more sets of injectors circumferentially arranged around the tube provide fluid communication for the working fluid through and into the tube. In particular embodiments, a fuel passage may surround one or more of the sets of injectors, and fuel ports may provide fluid communication for fuel to flow from the fuel passage into one or more of the sets of injectors. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 provides a simplified cross-section view of an exemplary gas turbine 10 incorporating one embodiment of the present invention. As shown, the gas turbine 10 may include a compressor 12 at the front, one or more combustors 14 radially disposed around the middle, and a turbine 16 at the rear. The compressor 12 and the turbine 16 typically share a common rotor 18 connected to a generator 20 to produce electricity.

The compressor 12 may be an axial flow compressor in which a working fluid 22, such as ambient air, enters the compressor 12 and passes through alternating stages of stationary vanes 24 and rotating blades 26. A compressor casing 28 contains the working fluid 22 as the stationary vanes 24 and rotating blades 26 accelerate and redirect the working fluid 22 to produce a continuous flow of compressed working fluid 22. The majority of the compressed working fluid 22 flows through a compressor discharge plenum 30 to the combustor 14.

The combustor 14 may be any type of combustor known in the art. For example, as shown in FIG. 1, a combustor casing 32 may circumferentially surround some or all of the combustor 14 to contain the compressed working fluid 22 flowing from the compressor 12. One or more fuel nozzles 34 may be radially arranged in an end cover 36 to supply fuel to a combustion chamber 38 downstream from the fuel nozzles 34. Possible fuels include, for example, one or more of blast furnace gas, coke oven gas, natural gas, vaporized liquefied natural gas (LNG), hydrogen, and propane. The compressed working fluid 22 may flow from the compressor discharge plenum 30 along the outside of the combustion chamber 38 before reaching the end cover 36 and reversing direction to flow through the fuel nozzles 34 to mix with the fuel. The mixture of fuel and compressed working fluid 22 flows into the combustion chamber 38 where it ignites to generate combustion gases having a high temperature and pressure. The combustion gases flow through a transition piece 40 to the turbine 16.

The turbine 16 may include alternating stages of stators 42 and rotating buckets 44. The first stage of stators 42 redirects and focuses the combustion gases onto the first stage of rotating buckets 44. As the combustion gases pass over the first stage of rotating buckets 44, the combustion gases expand, causing the rotating buckets 44 and rotor 18 to rotate. The combustion gases then flow to the next stage of stators 42 which redirects the combustion gases to the next stage of rotating buckets 44, and the process repeats for the following stages.

Figure 2:
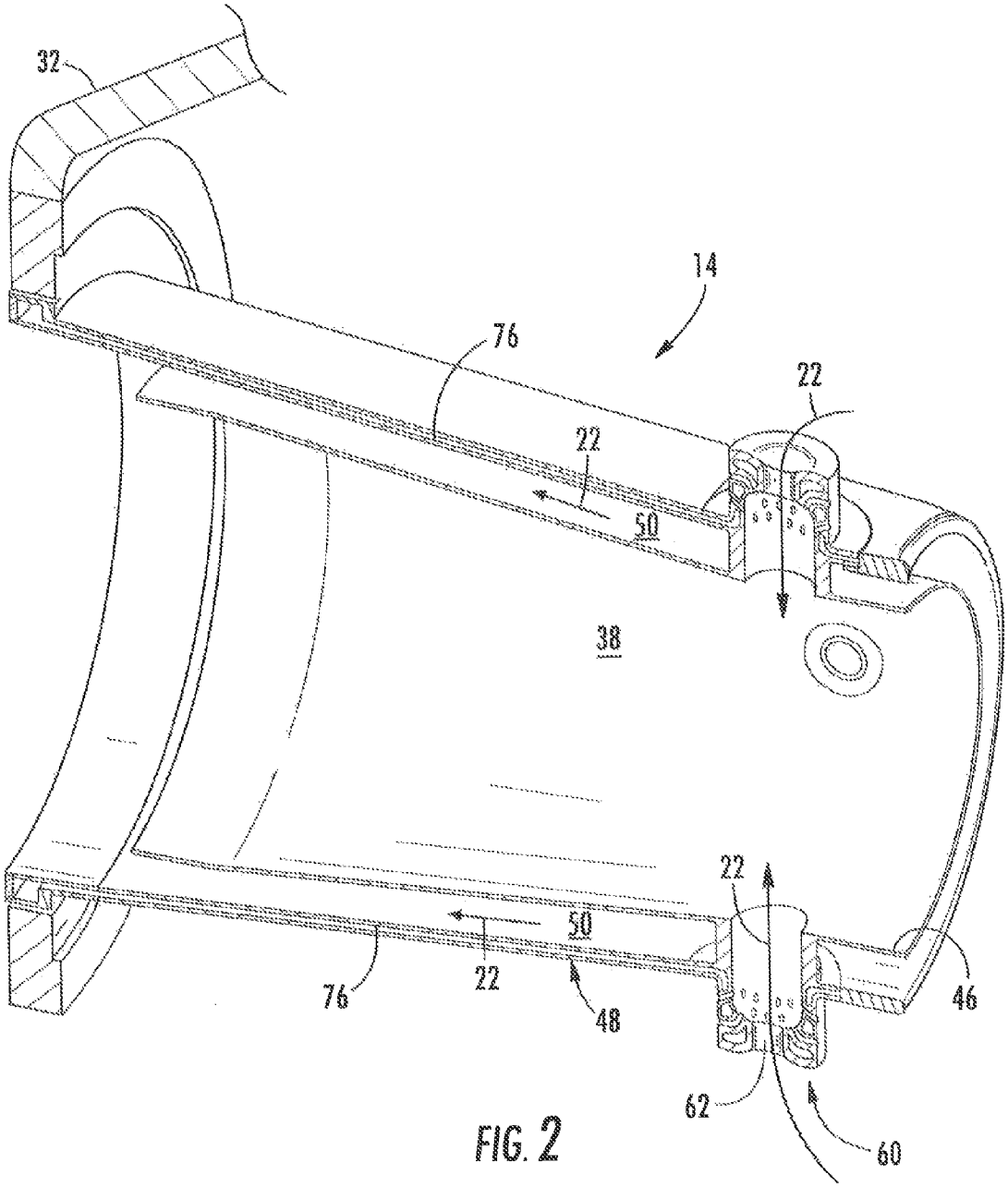
FIG. 2 is a simplified side perspective view of a portion of the combustor shown in FIG. 1 according to a first embodiment of the present invention.

FIG. 2 provides a simplified perspective view of a portion of the combustor 14 shown in FIG. 1 according to a first embodiment of the present invention. As shown, the combustor 14 may include a liner 46 that circumferentially surrounds at least a portion of the combustion chamber 38, and a flow sleeve 48 may circumferentially surround the liner 46 to define an annular passage 50 that surrounds the liner 46. In this manner, the compressed working fluid 22 from the compressor discharge plenum 30 may flow through the annular passage 50 along the outside of the liner 46 to provide convective cooling to the liner 46 before reversing direction to flow through the fuel nozzles 34 (shown in FIG. 1) and into the combustion chamber 38.

The combustor 14 may further include a plurality of late lean injectors 60 circumferentially arranged around the combustion chamber 38 to provide a lean mixture of fuel and compressed working fluid 22 into the combustion chamber 38. Each late lean injector 60 may generally include a tube 62 that provides fluid communication for the compressed working fluid 22 to flow through the flow sleeve 48 and the liner 46 and into the combustion chamber 38. As shown in FIG. 2, at least a portion of the tube 62 may extend radially outward from the flow sleeve 48.

Figure 3:
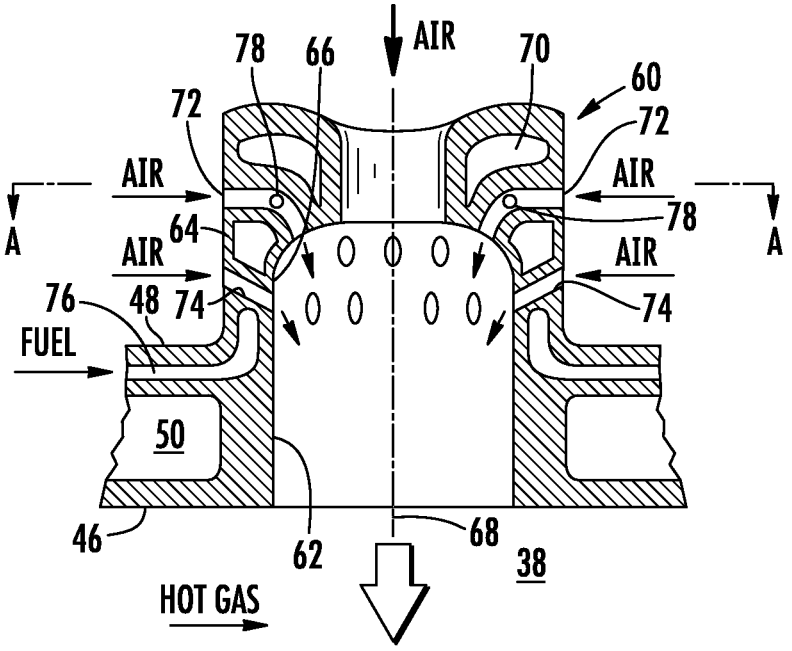
FIG. 3 is an enlarged side perspective view of the late lean injector shown in FIG. 2.
Figure 4:
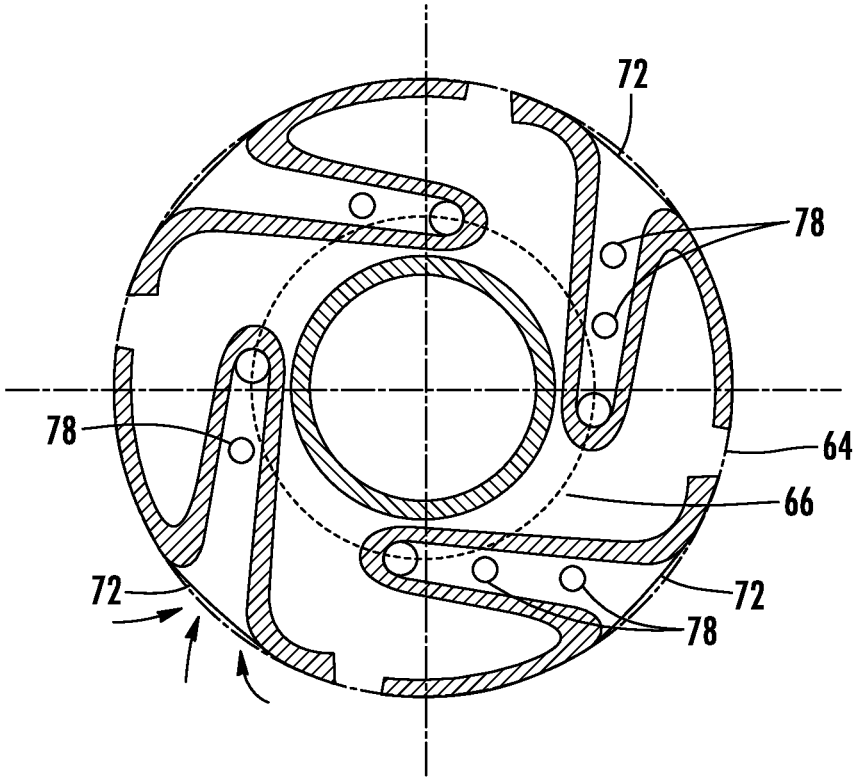
FIG. 4 is cross-section view of the late lean injector shown in FIG. 3 taken along line A-A.

FIGS. 3 and 4 provide enlarged views of the late lean injector 60 shown in FIG. 2 to illustrate various features and combinations of features that may be present in various embodiments of the present invention. Specifically, FIG. 3 provides an enlarged perspective view of the late lean injector 60 shown in FIG. 2, and FIG. 4 provides a cross-section view of the late lean injector 60 shown in FIG. 3 taken along line A-A. As shown in FIGS. 3 and 4, the tube 62 of the late lean injector 60 may include an outer wall 64, an inner wall 66, and an axial centerline 68. In particular embodiments, the outer and inner walls 64, 66 may be radially separated to form a fluid passage 70 between them.

Each tube 62 may further include one or more sets of injectors that provide fluid communication through the outer and inner walls 64, 66 and into the tube 62. For example, in the particular embodiment shown in FIGS. 3 and 4, each tube 62 includes first and second sets of injectors 72, 74 circumferentially arranged around the tube 62, and the first and second sets of injectors 72, 74 provide fluid communication for the compressed working fluid 22 to flow through the outer wall 64 and the inner wall 66 and into the tube 62.

A fuel plenum, tube, or other fluid pathway may supply fuel to the injectors. For example, as shown most clearly in FIG. 3, the flow sleeve 48 may include an internal fuel passage 76 in fluid communication with each tube 62. Specifically, as shown most clearly in FIG. 3, the fuel passage 76 may join with or extend into the fluid passage 70 between the outer and inner walls 64, 66 so that at least a portion of the fuel passage 76 surrounds at least a portion of the first and/or second sets of injectors 72, 74. In this manner, the compressed working fluid 22 flowing through the first and/or second sets of injectors 72, 74 may pre-heat the fuel flowing through the fuel passage 76 and/or fluid passage 70. As further shown in FIGS. 3 and 4, the first set of injectors 72 may include one or more fuel ports 78 that provide fluid communication from the fuel passage 76 into the first set of injectors 72. In this manner, the tubes 62 may receive the same or a different fuel than supplied to the fuel nozzles 34 and mix the fuel with a portion of the compressed working fluid 22 flowing through the center of the tubes 62. The resulting lean mixture of fuel and compressed working fluid 22 may then be injected into the combustion chamber 38 for additional combustion to raise the temperature, and thus the efficiency, of the combustor 14.

The first set of injectors 72 may be angled radially and/or axially with respect to the axial centerline 68 of the tube 62. In particular embodiments, the first set of injectors 72 may be angled substantially tangentially to the inner wall 66 of the tube 62, as best shown in FIG. 4. The radial and/or axial orientation of the first set of fuel injectors 74 with respect to the axial centerline 68 may result in one or more benefits that enhance mixing of the fuel and compressed working fluid 22 prior to injection into the combustion chamber 38. For example; the radial and/or axial angle between the first set of injectors 72 and the axial centerline 68 increases the length, volume, and/or surface area of the first set of injectors 72 between the outer and inner walls 64, 66 of the tube 62. This in turn increases the heat transfer from the compressed working fluid 22 flowing through the first set of injectors 72 to the fuel flowing around the first set of injectors 72. In addition, the additional volume inside the first set of injectors 72 increases the residence time of the fuel flowing inside the first set of injectors 72 which enhances mixing between the fuel and compressed working fluid 22 flowing through the first set of injectors 72 before reaching the tube 62 and subsequently being injected into the combustion chamber 38. The radial and/or axial angle of the first set of injectors 72 with respect to the axial centerline 68 may also induce swirl to the fuel-air mixture as it flows through the tube 62 and into the combustion chamber 38. The swirling mixture may reduce the amount of vortex shedding created by the late lean injection while also allowing the fuel-air mixture to penetrate further into the combustion chamber 38 to enhance mixing with the combustion gases.

As shown most clearly in FIG. 3, the second set of injectors 74 may be located downstream from the first set of injectors 72 and angled axially with respect to the axial centerline 68 of the tube 62. In this manner, the second set of injectors 74 may provide a layer, film, or blanket of compressed working fluid 22 along the inner wall 66 to separate the inner wall 66 from the fuel-air mixture flowing out of the first set of injectors 72 and into the tube 62. The layer, film, or blanket of compressed working fluid 22 along the inner wall 66 reduces the conditions conducive to flame holding and/or flashback inside the tube 62.

One of ordinary skill in the art will readily appreciate from the teachings herein that the late lean injectors 60 shown in FIG. 2 may include only one or more than one of the features described and illustrated in more detail in FIGS. 3 and 4, and embodiments of the present invention are not limited to any combination of such features unless specifically recited in the claims. In addition, the particular embodiments shown and described with respect to FIGS. 1-4 may also provide a method for supplying the working fluid 22 to the combustor 14. The method may include flowing the working fluid 22 from the compressor 12 through the combustion chamber 38 and diverting or flowing a portion of the working fluid 22 through the late lean injectors 60 circumferentially arranged around the combustion chamber 38. In particular embodiments, the method may further include spiraling and/or radially diverting a portion of the compressed working fluid 22 around the late lean injectors 60 and/or between the outer and inner walls 64, 66 of the tubes 62 prior to injection into the combustion chamber 38. Alternately or in addition, the method may include injecting a portion of the compressed working fluid 22 along the inner wall 66 of the tubes 62. The various features of the late lean injectors 60 described herein may thus enhance mixing between the fuel and compressed working fluid 22 prior to injection into the combustion chamber 38 to enhance NOx reduction. In addition, the various embodiments described herein may reduce the conditions conducive to flame holding inside the tubes 62.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A system for supplying a working fluid to a combustor, comprising:

a. a liner defining a combustion chamber within the combustor;

b. a flow sleeve that circumferentially surrounds at least a portion of the liner; and c. a tube that extends through the flow sleeve and the liner, the tube having an inner wall radially spaced from an outer wall, an inlet axially spaced from an outlet and a fluid passage defined within the tube between the inner and outer walls, the fluid passage being in fluid communication with a fuel passage, the inlet being in fluid communication with a compressed air supply and the outlet being in fluid communication with the combustion chamber;

d. wherein the tube defines a first set of injectors annularly arranged within the tube and angled radially with respect to an axial centerline of the tube, each injector providing for fluid communication of the working fluid through the outer wall and the inner wall, wherein the tube further defines at least one fuel port disposed within each injector of the first set of injectors between the outer and inner walls, and wherein each fuel port is in fluid communication with the fluid passage.

2. The system as in claim 1, wherein the first set of injectors are angled axially with respect to the axial centerline of the tube.

3. The system as in claim 1, further comprising a second set of injectors circumferentially arranged around the tube downstream from the first set of injectors, wherein the second set of injectors provide fluid communication for the working fluid to flow through the inner wall of the tube upstream from the outlet.

4. The system as in claim 3, wherein the second set of injectors are angled axially with respect to the axial centerline of the tube.

5. The system as in claim 1, wherein the fuel passage is at least partially defined between an inner wall and an outer wall of the flow sleeve.

6. The system as in claim 5, wherein at least a portion of the fuel passage surrounds at least a portion of the first set of injectors.

7. A system for supplying a working fluid to a combustor, comprising:

a. a combustion chamber;

b. a liner that circumferentially surrounds at least a portion of the combustion chamber;

c. a flow sleeve that circumferentially surrounds at least a portion of the liner;

d. a tube that provides fluid communication for the working fluid to flow through the flow sleeve and the liner and into the combustion chamber, the tube having an outer wall radially spaced from an inner wall;

e. a first set of injectors that provide fluid communication for the working fluid to flow through the outer and inner walls of the tube, wherein the first set of injectors are angled radially with respect to an axial centerline of the tube, wherein each injector of the first set of injectors includes a fuel port defined between the inner and outer walls; and f. a second set of injectors downstream from the first set of injectors, wherein the second set of injectors provide fluid communication for the working fluid to flow through the outer and inner walls of the tube.

8. The system as in claim 7, wherein the first set of injectors are angled axially with respect to the axial centerline of the tube.

9. The system as in claim 7, wherein the second set of injectors are angled axially with respect to the axial centerline of the tube.

10. The system as in claim 7, further comprising a fuel passage that surrounds at least a portion of the first and second sets of injectors, wherein the fuel passage is in fluid communication with the fuel ports.

* * * * *